US007204560B2

(12) United States Patent
Mercier et al.

(10) Patent No.: US 7,204,560 B2
(45) Date of Patent: Apr. 17, 2007

(54) ROTARY CUTTING BIT WITH MATERIAL-DEFLECTING LEDGE

(75) Inventors: Gregory David Mercier, Bristol, VA (US); Gary A. Fuller, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 10/641,138

(22) Filed: Aug. 15, 2003

(65) Prior Publication Data

US 2005/0035649 A1 Feb. 17, 2005

(51) Int. Cl.
*E21C 35/183* (2006.01)

(52) U.S. Cl. ..... 299/105; 299/104

(58) Field of Classification Search ..... 299/102–107, 299/110–111
See application file for complete search history.

(56) References Cited

U.S. PATENT DOCUMENTS

| | | | | |
|---|---|---|---|---|
| 3,746,396 | A | 7/1973 | Radd | |
| 3,807,804 | A | 4/1974 | Kniff | |
| 3,932,952 | A * | 1/1976 | Helton et al. | 37/460 |
| 3,945,681 | A | 3/1976 | White | |
| 4,489,986 | A | 12/1984 | Dziak | |
| 4,688,856 | A | 8/1987 | Elfgen | |
| 4,725,098 | A | 2/1988 | Beach | |
| 5,417,475 | A | 5/1995 | Graham et al. | |
| 5,823,632 | A | 10/1998 | Burkett | |
| 6,113,195 | A | 9/2000 | Mercier et al. | |
| 6,196,636 | B1 * | 3/2001 | Mills et al. | 299/111 |
| 6,378,952 | B1 | 4/2002 | Moosmann et al. | |
| 6,739,327 | B2 * | 5/2004 | Sollami | 125/36 |
| 6,758,530 | B2 * | 7/2004 | Sollami | 299/111 |
| 2003/0122414 | A1 * | 7/2003 | Sollami | 299/39.1 |
| 2003/0141753 | A1 * | 7/2003 | Peay et al. | 299/111 |
| 2004/0026983 | A1 * | 2/2004 | McAlvain | 299/111 |

FOREIGN PATENT DOCUMENTS

| | | | |
|---|---|---|---|
| DE | 3431495 | * | 3/1986 |
| DE | 3500261 | A1 | 7/1986 |
| DE | 3818213 | A1 | 11/1989 |
| DE | 101 63 717 | C1 | 5/2003 |
| GB | 2004315 | * | 3/1979 |
| GB | 2 037 223 | A | 11/1979 |
| GB | 2 055 928 | | 3/1981 |
| WO | 0252049 | * | 1/1988 |

* cited by examiner

*Primary Examiner*—Sunil Singh
(74) *Attorney, Agent, or Firm*—Drinker Biddle & Reath LLP

(57) ABSTRACT

A cutting bit includes a body having a front surface and a side surface, the side surface including a shoulder below the front surface and extending substantially perpendicular to a central axis of the body, and a ring that is harder than the body attached to the body at a front surface of the shoulder. Wear life of the cutting bit is enhanced by maintaining particular dimensional relationships regarding the position of the ring on the body, and the diameter of portions of the body.

20 Claims, 2 Drawing Sheets

ROTARY CUTTING BIT WITH MATERIAL-DEFLECTING LEDGE

BACKGROUND AND SUMMARY

The present invention relates to cutting tools used to cut through soft ground or through relatively soft material that has been laid on the ground, such as asphalt roadways.

Mining, excavating, and road resurfacing operations are typically performed by forcing rotary cutting bits through the material being cut. The cutting bits are mounted on a driven support, such as a rotary drum, fixed beam, or the like to be forced through the material. A typical cutting bit comprises a hard cemented carbide tip that is brazed to the front surface of a steel shank. The shank is to be mounted in a holder by means of a retainer sleeve which permits the bit to rotate freely relative to the holder about the bit's center axis, while being restrained against axial dislodgment from the holder. Due to being freely rotatable, the tip is basically self-sharpening.

It should be understood that cutting mechanisms of the type described above have been used to cut through hard materials, such as rock and ice, in addition to cutting through softer materials such as asphalt. During the cutting of rock, the highest rate of bit wear occurs at the carbide tip, so the wear life of the bit is determined by the carbide tip. However, during the cutting of relatively softer material, such as asphalt, coal, and salt, the highest rate of wear occurs at the shank, i.e., erosion caused by cut asphalt rubbing and impacting against the shank. Thus, when cutting asphalt during a road resurfacing operation, the wear life of the cutting bit is determined by the shank.

It would be desirable to provide a cutting bit that has an increased wear life when used for cutting softer materials such as asphalt.

Disclosed in U.S. Pat. No. 4,725,098, which is incorporated by reference, is a cutting bit in which a groove is machined in a tapering side surface of the bit head closely behind a carbide tip mounted in the bit head. Hardfacing is deposited into the groove to form an erosion-resistant annular ring which can be flush with, or project slightly radially beyond, the side surface. Despite being formed of hard material, the ring will be subjected to considerable erosion by cuttings and thus will have a somewhat limited life.

U.S. patent application Ser. No. 10/058,387, filed Jan. 30, 2002, entitled Rotary Cutting Bit with Material-Deflecting Ledge, naming Kent Peay and Timothy J. Shean as inventors, and now U.S. Pat. No. 6,709,065 which is incorporated by reference, discloses a cutting bit having a tapered side surface with a ledge projecting from the tapered surface. The ledge can be integral with the rest of the bit body or formed as a separate ring held on the body. The ledge is of sufficient diameter relative to the portion of the body above it that material cut tends to accumulate on the ledge and shields the body material underneath from erosion. However, it has been found that the ledge in such a cutting bit is highly prone to wear.

It would be desirable to provide a cutting bit with an erosion-resistant structure which has an enhanced life. It would also be desirable to provide a cutting bit that is simple to manufacture and involves relatively few manufacturing operations.

In accordance with an aspect of the present invention, a cutting bit includes a body having a front surface and a side surface, the side surface including a shoulder below the front surface and extending substantially perpendicular to a central axis of the body, the body being no larger in diameter above the shoulder than at the shoulder, and a ring that is harder than the body attached to the body at a front surface of the shoulder.

In accordance with another aspect of the present invention, a cutting bit includes a body having a front surface and a cylindrical side surface portion, the cylindrical side surface portion including a shoulder below the front surface and extending substantially perpendicular to a central axis of the body, and a ring that is harder than the body attached to the body at a front surface of the shoulder. A distance between the front surface and a top of the ring divided by a distance between the front surface and a bottom surface of the body is 0.15 to 0.5.

In accordance with yet another aspect of the present invention, a cutting bit includes a body having a front surface and a cylindrical side surface portion, the cylindrical side surface portion including a shoulder below the front surface and extending substantially perpendicular to a central axis of the body, a cutting tip attached to the front surface, and a ring that is harder than the body attached to the body at a front surface of the shoulder. A diameter of a bottom of the cutting tip divided by the diameter of the body at the bottom of the cutting tip is 0.72 to 0.95.

In accordance with yet another aspect of the present invention, a cutting bit includes a body having a front surface and a cylindrical side surface portion, the cylindrical side surface portion including a shoulder below the front surface and extending substantially perpendicular to a central axis of the body, a cutting tip attached to the front surface, and a ring that is harder than the body attached to the body at a front surface of the shoulder. A diameter of the cutting bit divided by an outside diameter of the ring is 0.60 to 0.80.

In accordance with yet another aspect of the present invention, a cutting bit includes a body having a front surface and a side surface, the side surface including a first shoulder below the front surface and extending substantially perpendicular to a central axis of the body, the body being no larger in diameter above the first shoulder than at the first shoulder, and a second shoulder below the first shoulder, the body being no larger in diameter above the second shoulder than at the second shoulder, and a first ring and a second ring attached to the body at a front surface of, respectively, the first shoulder and the second shoulder.

In accordance with still another aspect of the present invention, a cutting tip for being attached to a cutting bit includes a base portion, a tip portion, the tip portion being generally convex in shape, and a side portion extending between the base portion and the tip portion, the side portion being generally concave in shape.

In accordance with still another aspect of the present invention, a cutting bit includes a cutting tip having a base portion, a tip portion, the tip portion being generally convex in shape, and a side portion extending between the base portion and the tip portion, the side portion being generally concave in shape and intersecting with the tip portion at a junction. The cutting bit also includes a body having a front face to which the cutting tip is attached, a bottom portion, and a shoulder below the front surface and extending substantially perpendicular to a central axis of the body, and a ring that is harder than the body attached to the body at a front surface of the shoulder. An imaginary cone is defined by the junction and the bottom portion and the ring is disposed inside of the cone.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION

Figure 1:
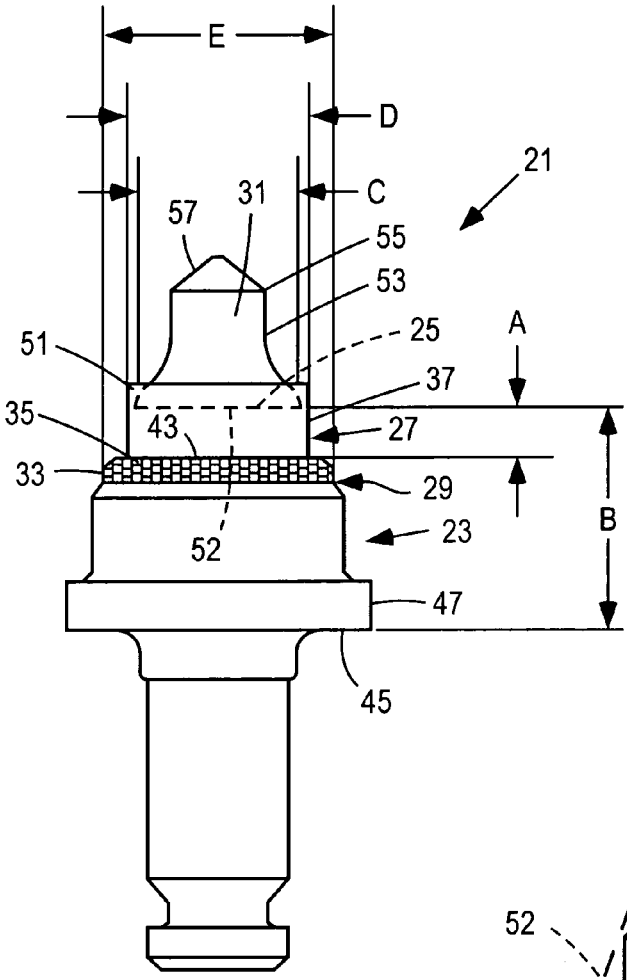
FIG. 1 is a side elevational view of a rotary cutting bit according to an embodiment of the present invention.
Figure 2:
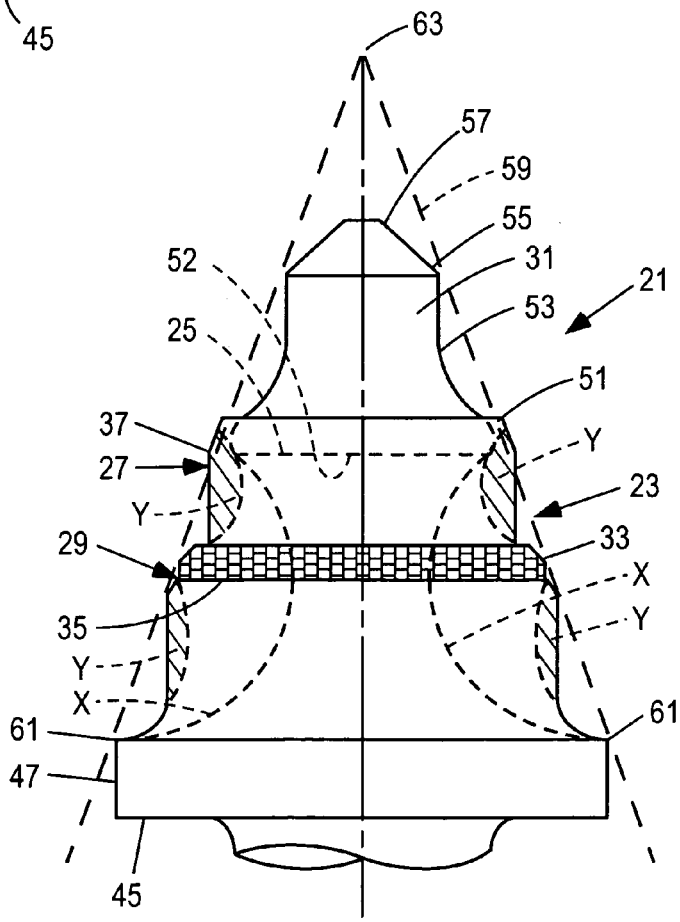
FIG. 2 is a side elevational view of a rotary cutting bit according to an embodiment of the present invention showing an accumulation of cut material on the bit.

A cutting bit 21 according to an embodiment of the present invention is shown in FIGS. 1 and 2. The cutting bit 21 includes a body 23 having a front surface 25 and a side surface 27. The side surface 27 includes a shoulder 29 below the front surface 25 and extending substantially perpendicular to a central axis of the body. A cutting tip 31 is preferably attached to the front surface 25, usually by brazing, the cutting tip preferably being harder than the body 23.

A ring 33 that is preferably harder than the body 23 is attached to the body at a front surface 35 of the shoulder 29, such as by brazing. The body 23 is preferably no larger in diameter above the shoulder 29 than at the shoulder and, preferably, at least a portion 37 of the side surface 27 of the body 23 is cylindrical, more preferably circularly cylindrical, above the shoulder 29 so that a ring having a circular inside diameter can be slid over the body to the shoulder. Because the body 23 is preferably no larger in diameter above the shoulder 29 than at the shoulder, it is not necessary to incur machining costs for machining a groove in the body. Also, the body 23 can be cold formed. The ring 33 is preferably positioned above the shoulder 29 and brazed to the body 23 in the same operation, which can minimize manufacturing costs, particularly when compared with bits wherein a groove must be formed. If desired or necessary, however, the shoulder 29 can be part of a groove in the side surface and the ring can be, for example, a split ring that is held in place by upper and lower surfaces of the groove. The ring 33 is illustrated as being a substantially circular shape, however, it will be appreciated that the ring can be any desired shape, such as hexagonal, octagonal, etc.

Figure 3:
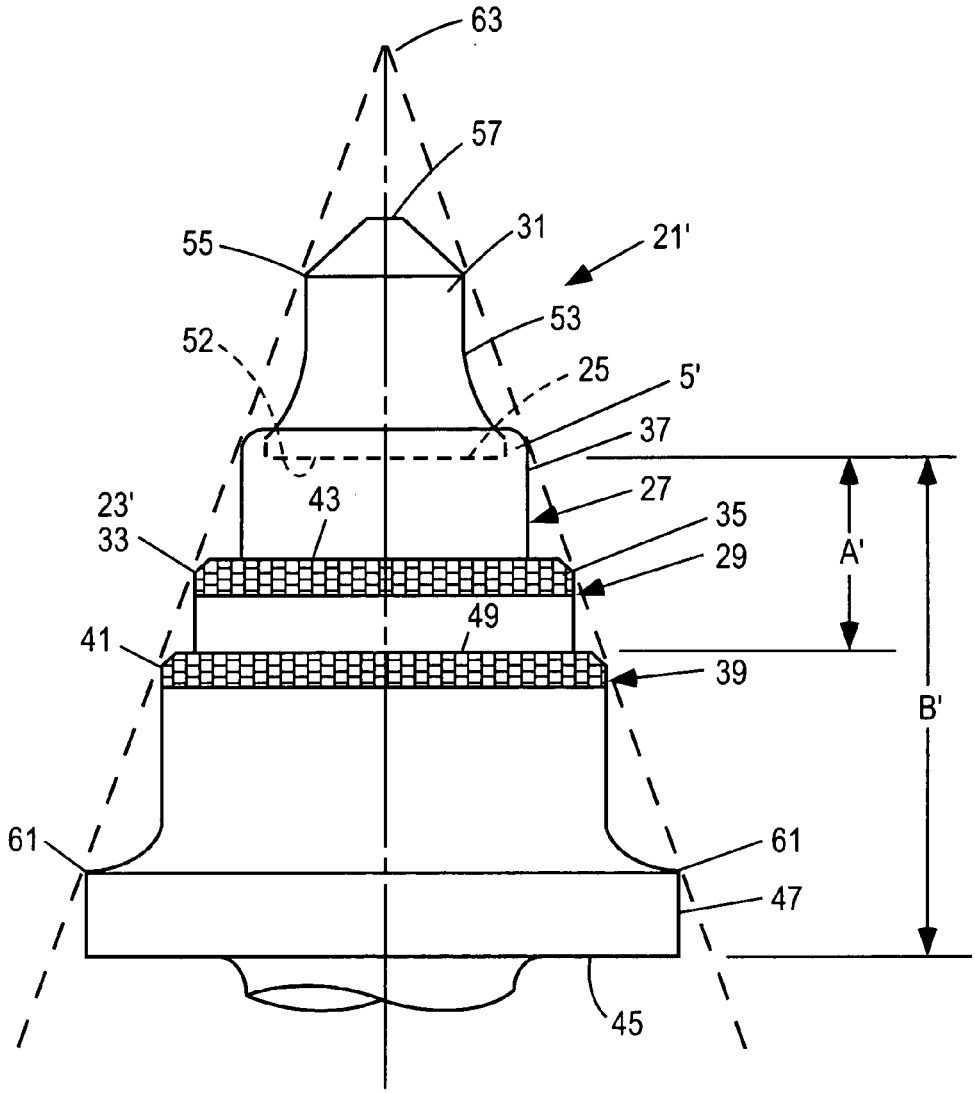
FIG. 3 is a side elevational view of a rotary cutting bit according to another embodiment of the present invention.

In the cutting bit 21' shown in FIG. 3, the body 23' includes a second shoulder 39 below the first shoulder 29. Again, the body 23' is preferably no larger in diameter above the second shoulder 39 than at the second shoulder to facilitate sliding a second ring 41 over the body to the second shoulder where it is attached to the body at a front surface of the second shoulder. Again, if desired or necessary, however, the shoulder 39 can be part of a groove in the side surface and the ring 41 can be, for example, a split ring that is held in place by upper and lower surfaces of the groove.

A distance A between the front surface 25 and a top 43 of the ring 33 divided by a distance B between the front surface and a bottom surface 45 of the body is preferably 0.15 to 0.5. It is intended that material being cut will accumulate on the ring 33 and the material will prevent erosion of the body 23 between the ring and the cutting tip 31 by deflecting further material. A flange 47, which is preferably integral with the body, is preferably provided at the bottom of the body 23. Cut material tends to accumulate on the flange 47 in a manner similar to the manner in which material accumulates on the ring 33.

In the past, a wear pattern between a cutting tip and a bottom flange on a body would tend to approximate the "golf tee" shape shown by the dotted line X in FIG. 2. It has been found that providing the ring 33 in a region that would ordinarily be subject to significant erosion results in a substantially reduced volume loss of material from the body 23 and tends to approximate the double "golf tee" shape shown as the shaded area Y in FIG. 2. While it is desirable to prevent body wear, it is also desirable to ensure that the ring 33 is at a sufficient distance from the cutting tip 31 to avoid a dulling of the cutting action, which can be achieved by keeping the relationship between distance A and distance B in the range of 0.15 to 0.5. Moreover, in the illustrated embodiment of FIG. 2, if the side surfaces of the tip 31 are extrapolated to define a ninety degree angle relative to the center axis of the body, then the leas of the ninety degree angle will define an area in which the ring 33 is preferably situated. If a second shoulder 39 and ring 41 are provided as in FIG. 3, it is preferred that a distance A' between the front surface 25 and a top 49 of the second ring 41 divided by the distance B between the front surface and a bottom surface 45 of the body is, as with the first ring 33, 0.15 to 0.5. This tends to place both the first ring 33 and the second ring 41 in what would otherwise be a region of maximum erosion on the body 23.

A diameter C of the cutting tip 31 divided by a diameter D of the body 23 at the bottom of the cutting tip is preferably 0.72 to 0.95. The front surface 25 is preferably recessed to define a dam wall 51 in which the cutting tip 31 is attached by brazing. Purposes of the dam wall 51 include preventing brazing liquid from flowing out from between the cutting tip 31 and the front surface 25 and acting as a stress reliever when the body 23 cools off. As C/D becomes closer to 1, the thickness of the dam wall 51 is reduced and less material is needed to form the body 23. As C/D moves from 1 toward 0, the body 23 has more material and its useful life span tends to approach that of the cutting tip 31 made of harder material.

The diameter C of the cutting tip 31 divided by an outside diameter E of the ring is preferably 0.60 to 0.80. As seen in FIGS. 1–3, the cutting tip 31 preferably has a bottom surface 52 that is brazed to the front surface 25 inside the dam wall 51, a concave surface portion 53 extending upwardly to a break point 55, and a tip portion 57 that is generally convex. As seen in FIGS. 2 and 3, an imaginary cone 59 extends through a point 61 on the outer edge of the flange 47 and the break point 55 to a point 63 above the tip portion 57 along the center axis of the body 23. It has been found desirable to keep all points on the cutting bit 21, including points on the ring 33, inside or at least substantially inside of this cone 59. Points extending outwardly beyond the cone tend to be too vulnerable to erosion. By keeping C/E in the range of 0.60 to 0.80, particularly when A/B is 0.15 to 0.50 and C/D is 0.72 to 0.95, the outermost point on the ring 33 tends to fall on or inside of the cone 59 and is less subject to wear. The relationships described above in connection with the cutting bit having only the ring 33 are preferably also true for bits having two or more rings, e.g., the bit 21' including the ring 41 shown in FIG. 3.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A cutting bit comprising:

a body having a front surface and a cylindrical side surface portion, the cylindrical side surface portion including a shoulder below the front surface and extending substantially perpendicular to a central axis of the body, at least a portion of the cylindrical side surface portion being disposed above the shoulder; and a ring that is harder than the body attached to the body at a front surface of the shoulder such that the entire said ring is disposed below the front surface of the body, wherein a distance between the front surface and a top of the ring divided by a distance between the front surface and a bottom surface of the body is 0.15 to 0.5., and wherein the body includes a second shoulder below the first shoulder, the body being no larger in diameter above the second shoulder than at the second shoulder, and the cutting bit comprising a second ring attached to the body at a front surface of the second shoulder, wherein a distance between the front surface and a top of the second ring divided by a distance between the front surface and a bottom surface of the body is 0.15 to 0.5.

2. A cutting bit comprising:

a body having a front surface and a cylindrical side surface portion, the cylindrical side surface portion including a shoulder below the front surface and extending substantially perpendicular to a central axis of the body, at least a portion of the cylindrical side surface portion being disposed above the shoulder:

a ring that is harder than the body attached to the body at a front surface of the shoulder such that the entire said ring is disposed below the front surface of the body; and a cutting tip attached to the front surface, wherein a distance between the front surface and a top of the ring divided by a distance between the front surface and a bottom surface of the body is 0.15 to 0.5, and wherein a diameter of a bottom of the cutting tip divided by the diameter of the body at the bottom of the cutting tip is 0.72 to 0.95.

3. The cutting bit as set forth in claim 2, further includes an elongate portion disposed below the bottom surface of the body and extending from the bottom surface of the body in the direction of the central axis, the elongate portion being adapted to receive a retainer sleeve for mounting the cutting bit in a holder.

4. The cutting bit as set forth in claim 3, wherein a diameter of the cutting tip divided by an outside diameter of the ring is 0.60 to 0.80.

5. The cutting bit as set forth in claim 4, the cutting tip being harder than the body, the diameter of the body above the shoulder being no larger than the diameter of the shoulder, and the ring being attached to the front surface of the shoulder by brazing.

6. The cutting bit as set forth in claim 5, the cutting tip having a base portion, a tip portion, and a side portion extending between the base portion and the tip portion, the tip portion being generally convex in shape, and the side portion being generally concave in shape.

7. The cutting bit as set forth in claim 3, the cutting tip being harder than the body, the diameter of the body above the shoulder being no larger than the diameter of the shoulder, and the ring being attached to the front surface of the shoulder by brazing.

8. The cutting bit as set forth in claim 3, wherein a diameter of the cutting tip divided by an outside diameter of the ring is 0.60 to 0.80.

9. A cutting bit, comprising:

a body having a substantially planar front surface and a cylindrical side surface portion, the cylindrical side surface portion including a shoulder below the front surface and extending substantially perpendicular to a central axis of the body, at least a portion of the cylindrical side surface portion being disposed above the shoulder;

a cutting tip attached to the front surface; and a ring that is harder than the body attached to the body at a front surface of the shoulder such that the entire said ring is disposed below the front surface of the body, wherein a diameter of a bottom of the cutting tip divided by the diameter of the body at the bottom of the cutting tip is 0.72 to 0.95.

10. The cutting bit as set forth in claim 9, wherein the body includes a second shoulder below the first shoulder, the body being no larger in diameter above the second shoulder than at the second shoulder, and the cutting bit comprising a second ring attached to the body at a front surface of the second shoulder.

11. The cutting bit as set forth in claim 9, wherein a diameter of the cutting tip divided by an outside diameter of the ring is 0.60 to 0.80.

12. A cutting bit comprising:

a body having a substantially planar front surface and a cylindrical side surface portion, the cylindrical side surface portion including a shoulder below the front surface and extending substantially perpendicular to a central axis of the body, at least a portion of the cylindrical side surface portion being disposed above the shoulder;

a cutting tip attached to the front surface; and a ring that is harder than the body attached to the body at a front surface of the shoulder such that the entire said ring is disposed below the front surface of the body, wherein said ring is attached the front surface of the shoulder by brazing, and wherein a diameter of the cutting tip divided by an outside diameter of the ring is 0.60 to 0.80, and wherein the body includes a second shoulder below the first shoulder, the body being no larger in diameter above the second shoulder than at the second shoulder, and the cutting bit comprising a second ring attached to the body at a front surface of the second shoulder.

13. A cutting bit, comprising:

a body having a front surface and a side surface, the side surface including a first shoulder below the front surface and extending substantially perpendicular to a central axis of the body, the body being no larger in diameter above the first shoulder than at the first shoulder, and a second shoulder below the first shoulder, the body being no larger in diameter above the second shoulder than at the second shoulder; and a first ring and a second ring attached to the body at a front surface of, respectively, the first shoulder and the second shoulder such that the entire said first ring and the entire said second ring are disposed below the front surface of the body;

wherein at least a portion of the side surface disposed above the first shoulder is cylindrical and at least a portion of the side surface disposed above the second shoulder is cylindrical.

14. The cutting bit as set forth in claim 13, wherein a distance between the front surface and a top of the ring divided by a distance between the front surface and a bottom surface of the body is 0.15 to 0.5.

15. The cutting bit as set forth in claim 13, further comprising a cutting tip attached to the front surface.

16. The cutting bit as set forth in claim 13, wherein a diameter of a bottom of the cutting tip divided by the diameter of the body at the bottom of the cutting tip is 0.72 to 0.95.

17. The cutting bit as set forth in claim 13, wherein a diameter of the cutting bit to an outside diameter of the first ring is 0.60 to 0.80.

18. The cutting bit as set forth in claim 13, wherein the first and second rings are harder than the body.

19. A cutting bit, comprising:

a cutting tip having a base portion, a tip portion, the tip portion being generally convex in shape, and a side portion extending between the base portion and the tip portion, the side portion being generally concave in shape and intersecting with the tip portion at a junction;

a body having a front face to which the cutting tip is attached, a bottom portion, and a shoulder below the front surface and extending substantially perpendicular to a central axis of the body; and a ring that is harder than the body attached to the body at a front surface of the shoulder such that the entire said ring is disposed below the front surface of the body, wherein at least a portion of the side surface disposed above the shoulder is cylindrical; and wherein a ninety degree angle is defined relative to the junction and the center axis of the body, and wherein the ring is disposed inside of extended legs of the defined ninety degree angle.

20. The cutting bit as set forth in claim 19, wherein all portions of the cutting bit between the tip portion and the bottom portion are disposed substantially inside of a phantom cone defined by the extended legs.

* * * * *

UNITED STATES PATENT AND TRADEMARK OFFICE

CERTIFICATE OF CORRECTION

PATENT NO. : 7,204,560 B2
APPLICATION NO. : 10/641138
DATED : April 17, 2007
INVENTOR(S) : Mercier et al.

It is certified that error appears in the above-identified patent and that said Letters Patent is hereby corrected as shown below:

At column 6, line 1, of claim 8, please replace “in claim 3” with -- in claim 2--.

Signed and Sealed this

Eighteenth Day of September, 2007

JON W. DUDAS
*Director of the United States Patent and Trademark Office*